US009976493B2

(12) United States Patent
Shewell

(10) Patent No.: US 9,976,493 B2
(45) **Date of Patent: *May 22, 2018**

(54) SWITCHABLE ROCKER ARM WITH REDUCED COUPLING ASSEMBLY LOADS

(71) Applicant: Schaeffler Technologies AG & Co. KG, Herzogenaurach (DE)

(72) Inventor: Jeffrey Shewell, Rochester, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 126 days.

This patent is subject to a terminal disclaimer.

(21) Appl. No.: 15/088,195

(22) Filed: Apr. 1, 2016

(65) Prior Publication Data

US 2017/0284313 A1 Oct. 5, 2017

(51) Int. Cl.

| | |
|---|---|
| ***F01L 1/18*** | (2006.01) |
| ***F02D 13/02*** | (2006.01) |
| ***F01L 13/00*** | (2006.01) |
| ***F01L 1/34*** | (2006.01) |

(52) U.S. Cl.

CPC ..... *F02D 13/0211* (2013.01); *F01L 1/34* (2013.01); *F01L 13/0026* (2013.01); *F01L 1/18* (2013.01); *F01L 1/185* (2013.01); *F01L 2001/186* (2013.01)

(58) Field of Classification Search

CPC ..... F01L 1/18; F01L 1/185; F01L 2001/186; F01L 13/0026; F01L 13/0211

USPC ..... 123/90.39, 90.44

See application file for complete search history.

(56) References Cited

U.S. PATENT DOCUMENTS

| | | | | |
|---|---|---|---|---|
| 7,712,443 | B2 | 5/2010 | Gemein | |
| 8,689,753 | B2 * | 4/2014 | Villemure | F01L 1/053 123/90.39 |
| 8,915,225 | B2 | 12/2014 | Zurface et al. | |
| 2007/0193543 | A1 | 8/2007 | Best | |

* cited by examiner

*Primary Examiner* — Ching Chang

(74) *Attorney, Agent, or Firm* — Matthew V. Evans

(57) ABSTRACT

A switchable rocker arm for valve deactivation is provided for a valve train of an internal combustion engine. The switchable rocker arm includes a valve side lever assembly, a cam side lever assembly, and a hydraulically actuated coupling assembly. The valve side lever assembly includes a first housing with a first rocker shaft bore. The cam side lever assembly includes a second housing with a first arm with a second rocker shaft bore and a second arm with a third rocker shaft bore. The first and second arms extend along opposed longitudinal sides of the cam side lever assembly such that the first, second and third rocker shaft bores are axially aligned. The coupling assembly is arranged at an end furthest away from a pivot axis for minimal loading and provides locking and unlocking of the switchable rocker arm to achieve full valve lift and no valve lift modes, respectively.

16 Claims, 9 Drawing Sheets

SWITCHABLE ROCKER ARM WITH REDUCED COUPLING ASSEMBLY LOADS

BACKGROUND

The present invention relates to a switchable rocker arm for a valve train of an internal combustion (IC) engine, and more particularly, to the coupling assembly of a switchable rocker arm that provides two discrete valve lift modes.

More stringent fuel economy regulations in the transportation industry have prompted the need for improved efficiency of the IC engine. Lightweighting, friction reduction, thermal management, variable valve timing and a diverse array of variable valve lift technologies are all part of the technology toolbox for IC engine designers.

Variable valve lift (VVL) systems typically employ a technology in a valve train of an IC engine that allows different engine valve lifts to occur. The valve train consists of the components that are required to actuate an engine valve, including a camshaft (also termed "cam"), the valve, and all components that lie in between. VVL systems are typically divided into two categories: continuous variable and discrete variable. Continuous variable valve lift systems are capable of varying a valve lift from a design lift minimum to a design lift maximum to achieve any of several lift heights. Discrete variable valve lift systems are capable of switching between two or three distinct valve lifts. Components that enable these different valve lift modes are often called switchable valve train components. Typical two-step discrete valve lift systems switch between a full valve lift mode and a partial valve lift mode, often termed cam profile switching, or between a full valve lift mode and a no valve lift mode that facilitates deactivation of the valve. Valve deactivation can be applied in different ways. In the case of a four-valve-per-cylinder configuration (two intake+ two exhaust), one of two intake valves can be deactivated. Deactivating only one of the two intake valves can provide for an increased swirl condition that enhances combustion of the air-fuel mixture. In another scenario, all of the intake and exhaust valves are deactivated for a selected cylinder which facilitates cylinder deactivation. On most engines, cylinder deactivation is applied to a fixed set of cylinders, when lightly loaded at steady-state speeds, to achieve the fuel economy of a smaller displacement engine. A lightly loaded engine running with a reduced amount of active cylinders requires a higher intake manifold pressure, and, thus, greater throttle plate opening, than an engine running with all of its cylinders in the active state. Given the lower intake restriction, throttling losses are reduced in the cylinder deactivation mode and the engine runs with greater efficiency. For those engines that deactivate half of the cylinders, it is typical in the engine industry to deactivate every other cylinder in the firing order to ensure smoothness of engine operation while in this mode. Deactivation also includes shutting off the fuel to the dormant cylinders. Reactivation of dormant cylinders occurs when the driver demands more power for acceleration. The smooth transition between normal and partial engine operation is achieved by controlling ignition timing, cam timing and throttle position, as managed by the engine control unit (ECU). Examples of switchable valve train components that serve as cylinder deactivation facilitators include roller lifters, pivot elements, rocker arms and camshafts; each of these components is able to switch from a full valve lift mode to a no valve lift mode. The switching of lifts occurs on the base circle or non-lift portion of the camshaft; therefore the time to switch from one mode to another is limited by the time that the camshaft is rotating through its base circle portion; more time for switching is available at lower engine speeds and less time is available at higher engine speeds. Maximum switching engine speeds are defined by whether there is enough time available on the base circle portion to fully actuate a coupling assembly to achieve the desired lift mode.

The precision of control of the deactivated cylinders varies within the engine industry. For optimum performance of the system, selective cylinder control rather than simultaneous multiple cylinder control is recommended. With selective cylinder control, the timing of the valve deactivation event with respect to the combustion cycle is maintained for each individual cylinder; for example, in a selective cylinder control system, an exhaust charge is normally trapped in the cylinder, which serves as an air spring and aids oil control during the deactivated mode. This is typically accomplished by deactivating the exhaust valve(s) first, followed by deactivation of the intake valve(s) of a given cylinder. With simultaneous multiple cylinder control, the timing of the valve deactivation event with respect to the combustion cycle is not controlled to the extent of the selective cylinder control resulting in intermittent exhaust charge trapping.

In today's IC engines, many of the switchable valve train components that enable valve deactivation for cylinder deactivation contain a coupling or locking assembly that is actuated by an electro-hydraulic system. The electro-hydraulic system typically contains at least one solenoid valve within an array of oil galleries that manages engine oil pressure to either lock or unlock the coupling assembly within the switchable valve train component to enable a valve lift switching event. These types of electro-hydraulic systems require time within the combustion cycle to actuate the switchable valve train component.

In most IC engine applications, switchable valve train components for cylinder deactivation in an electro-hydraulic system are classified as "pressureless-locked", which equates to:

a). In a no or low oil pressure condition, the spring-biased coupling assembly will be in a locked position, facilitating the function of a standard valve train component that translates rotary camshaft motion to linear valve motion; and, b). In a condition in which engine oil pressure is delivered to the coupling assembly that exceeds the force of the coupling assembly bias spring, the coupling assembly will be displaced a given stroke to an unlocked position, facilitating valve deactivation where the rotary camshaft motion is not translated to the valve.

"Pressureless-unlocked" electro-hydraulic systems can be found in some cam profile switching systems that switch between a full valve lift and a partial valve lift, which equates to:

a). In a no or low oil pressure condition, the spring-biased coupling assembly will be in an unlocked position, facilitating a partial valve lift event; and, b). In a condition in which engine oil pressure is delivered to the coupling assembly that exceeds the force of the coupling assembly bias spring, the coupling assembly will be displaced a given stroke to a locked position, facilitating a full valve lift event.

With the successful implementation of cylinder deactivation systems on millions of production engines, engine manufacturers are now looking to expand the operating range. Examples include switching at higher engine speeds along with switching at colder oil temperatures. In addition, a new type of cylinder deactivation is in development that expands the deactivated mode operating range, increases the number of deactivating cylinders, and increases the frequency of switching in and out of a deactivated mode. In this new type of cylinder deactivation, all cylinders, as opposed to a group of cylinders, are continuously switched on and off depending on the demanded engine output. By controlling the engine output over a larger operating range in this way instead of by conventional throttling, pumping losses are reduced even further compared to traditional cylinder deactivation systems and, thus, a higher engine efficiency is achieved.

Vital to the durability and performance of a switchable valve train component is the robustness of the coupling assembly. Two important design attributes of the coupling assembly include: 1). the ability to switch from a locked to an unlocked position very quickly, and 2). a high resistance to wear. However, many times these attributes are in opposition. For example, the locking/unlocking stroke of the coupling assembly to engage/disengage an adjacent component has a direct impact on switching times; a shorter stroke for a given cross-sectional area of a coupling assembly will likely yield a faster switching time. Yet, a shorter stroke typically dictates a smaller contact area with the engaged or disengaged component, meaning that a given load is applied over a smaller area leading to higher contact pressures and subsequent wear. For this reason, various coupling assembly forms, materials, coatings and heat treatments are often employed in an effort to maximize wear resistance in order to minimize the actuation stroke and resultant contact area.

Given the aforementioned design challenges and more stringent switching time demands for switchable valve train components, a coupling assembly for improved wear and actuation times is required. Therefore, a primary objective of this invention is to locate the coupling assembly at a position within a switchable rocker arm that reduces the load and resultant wear on the coupling assembly.

SUMMARY

A switchable rocker arm for valve deactivation that pivots about a rocker shaft is provided for a valve train of an internal combustion engine. The switchable rocker arm includes a valve side lever assembly, a cam side lever assembly, and a hydraulically actuated coupling assembly. The hydraulically actuated coupling assembly is located at a position within the switchable rocker arm that minimizes loads and resultant wear on the coupling assembly. The hydraulically actuated coupling assembly facilitates two valve lift modes: a full valve lift mode and a no valve lift mode. The full valve lift mode is achieved when the valve side lever assembly is coupled or locked to the cam side lever assembly; thereby, when a camshaft rotationally actuates the cam side lever assembly, both assemblies pivot together in unison about the rocker shaft, allowing rotary motion of the camshaft to be translated to linear motion of an engine valve. The no valve lift mode results when the valve side lever assembly is uncoupled or unlocked from the cam side lever assembly; thereby, when the camshaft rotationally actuates the cam side lever assembly, only the cam side lever assembly rotates about the rocker shaft while the valve side lever assembly remains stationary, preventing translation of the rotary motion of the camshaft to the engine valve.

The valve side lever assembly includes a first housing with two axially offset arms at one end defining a cavity, and a valve interface and shuttle pin bore that houses a hydraulically actuated shuttle pin at an opposite end. The valve interface can be in the form of a hydraulic lash adjuster, as provided in a first embodiment, or an adjusting screw assembly, as provided in a second embodiment. Each of the two arms has a rocker shaft bore to interface with and pivot about the rocker shaft.

The cam side lever assembly includes a second housing with a cam interface at one end, a locking pin bore at an opposite end, and a rocker shaft bore between the two ends to pivot about the rocker shaft. The cam side lever assembly resides in the cavity formed by the two offset arms of the first housing of the valve side lever assembly in such a way that the two rocker shaft bores of the first housing are axially aligned with the rocker shaft bore of the second housing. A limited rotational position of the cam side lever assembly with respect to the valve side lever assembly is provided by two inwardly protruding stops located on each of the two axially offset arms of the first housing of the valve side lever assembly. The cam interface can be in the form of a roller follower assembly or a sliding pad. The locking pin bore houses a locking pin, in contact with a bias spring or resilient element that is displaced by the adjacent hydraulically actuated shuttle pin. Optionally, a sleeve can be arranged within the locking pin bore to house the locking pin.

The locking pin moves in a longitudinal direction within the locking pin bore (or sleeve) to achieve a first locked position and a second unlocked position. The first locked position results when the locking pin bore of the second housing is axially aligned with the shuttle pin bore of the first housing, enabling engagement of the locking pin with both the locking pin bore and the shuttle pin bore. In this position, the bias spring or resilient element in contact with one end of the locking pin is compressed and provides a pre-load to the locking pin; additionally, the position of the locking pin is defined by a first distance from an outer end of the locking pin to a blind or closed end of the locking pin bore, and the position of the shuttle pin is defined by a second distance from an outer end of the shuttle pin to a blind or closed end of the shuttle pin bore. The first locked position fulfills a full valve lift or activated valve mode during which rotational cam lift is translated to linear valve lift.

The second unlocked position results when hydraulic pressure, typically engine oil pressure, is applied to the adjacent shuttle pin engaged with the locking pin. The force created by the hydraulic pressure acting on the shuttle pin overcomes the pre-load of the compressed bias spring acting on the adjacent locking pin, causing the locking pin to move longitudinally to the second unlocked position at which the locking pin is disengaged with the shuttle pin bore. In this unlocked position, the bias spring contacting the locking pin is compressed further than in the first locked position; additionally, compared to the first unlocked position, the locking pin is closer to the closed end of the locking pin bore, defined by a third distance, and the shuttle pin is further away from the closed end of the shuttle pin bore, defined by a fourth distance. While in the second unlocked mode, the cam side lever assembly is rotationally displaced about the rocker shaft by the camshaft separately from the valve side lever assembly, which remains stationary, fulfilling a no valve lift or deactivated valve mode. A lost motion spring or resilient element is arranged between the cam side and valve side arm assemblies to provide a force during the second unlocked mode that can, a). control the motion of the cam side lever assembly such that separation with the camshaft does not occur at a maximum deactivation engine speed, and, b). act upon the valve side lever assembly to prevent pump-up of the optional hydraulic lash adjuster.

Multiple variations of an oil gallery or fluid passage network within the first housing of the valve side lever assembly are possible to transport oil from the rocker shaft to accommodate the previously described functions and component options. For a fluid passage network of the first embodiment of the switchable rocker arm that contains a hydraulic lash adjuster to serve as the valve interface, the shuttle pin can receive hydraulic fluid from at least one fluid passage within either or both axially offset arms that first feeds the hydraulic lash adjuster, followed by the shuttle pin, in series. In a variation of this fluid passage, separate fluid passages for the shuttle pin and hydraulic lash adjuster can exist within either or both arms for the hydraulic lash adjuster and shuttle pin. A fluid passage network for the second embodiment of the switchable rocker arm that contains an adjusting screw assembly to serve as the valve interface requires only a fluid passage or passages within either or both of the axially offset arms to feed the shuttle pin. The adjusting screw assembly typically does not need an oil feed, however, if one is needed, either of the previously described fluid passage networks could be applied.

A location of the hydraulically actuated coupling assembly within the switchable rocker arm is specified at the valve end of the switchable rocker arm in order to facilitate a maximum distance between a locking interface and the switchable rocker arm pivot point. While in the first locked position that facilitates the full valve lift mode, the switchable rocker arm is subjected to a load throughout the valve lift event causing the locking pin to be loaded in shear due to its partial position within the locking pin bore and the shuttle pin bore. A magnitude of this shear load is proportional to a distance from the rocker arm pivot point to where the locking pin is loaded in shear. Therefore, placement of the coupling assembly at a location that is furthest away from the rocker arm pivot point will yield lower shear loads and subsequently lower wear of the coupling assembly.

BRIEF DESCRIPTION OF THE DRAWINGS

The foregoing Summary as well as the following Detailed Description will be best understood when read in conjunction with the appended drawings. In the drawings.

DETAILED DESCRIPTION OF THE PREFERRED EMBODIMENTS

Figure 1:
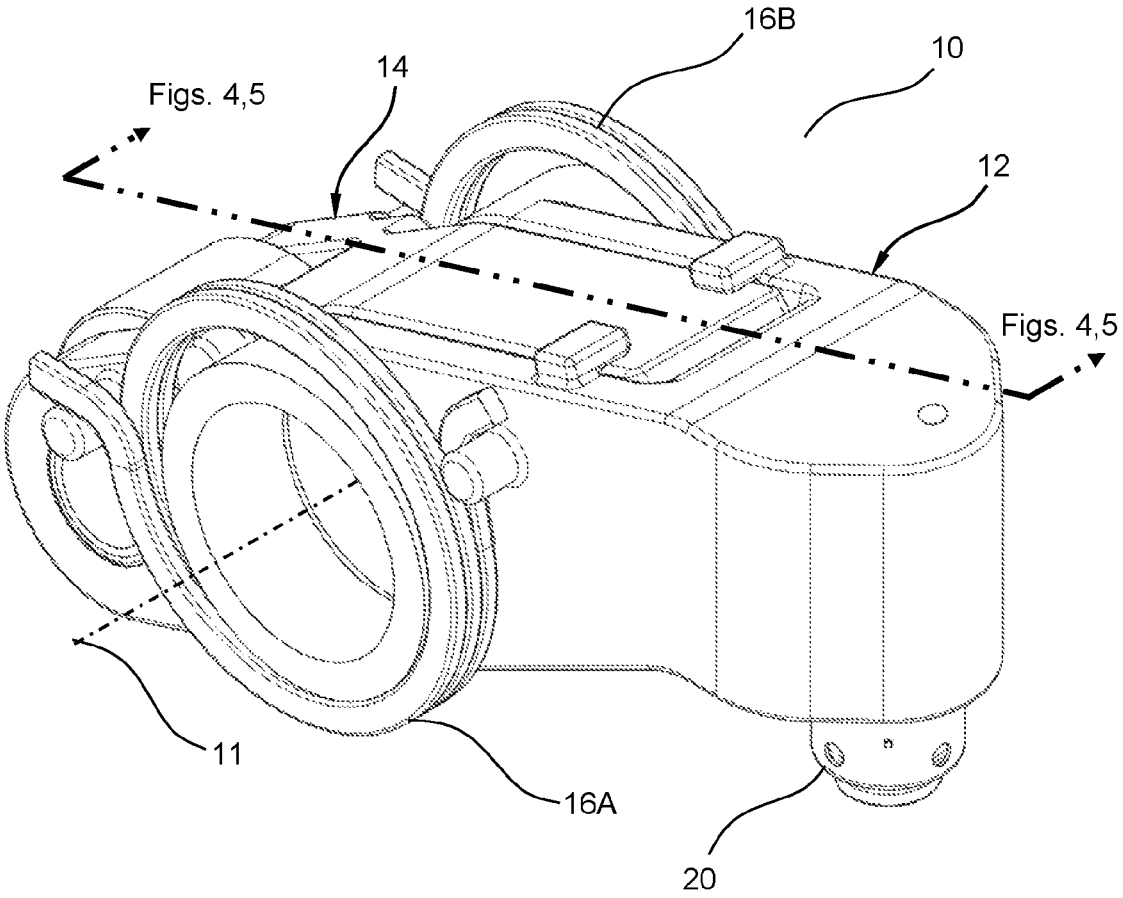
FIG. 1 is a perspective view of a first embodiment of a switchable rocker arm.

Certain terminology is used in the following description for convenience only and is not limiting. The words "inner," "outer," "inwardly," and "outwardly" refer to directions towards and away from the parts referenced in the drawings. A reference to a list of items that are cited as "at least one of a, b, or c" (where a, b, and c represent the items being listed) means any single one of the items a, b, c or combinations thereof. The terminology includes the words specifically noted above, derivatives thereof, and words of similar import.

Referring to FIGS. 1 through 5, a first embodiment of a switchable rocker arm 10 that provides for reduced coupling assembly loads is shown. The switchable rocker arm 10 is capable of switching between two discrete valve lift modes. The components of the switchable rocker arm 10 include a valve side lever assembly 12, a cam side lever assembly 14, a first lost motion spring 16A, and a second lost motion spring 16B. Those familiar with switchable valve train components are aware that various forms of lost motion springs are possible. The switchable rocker arm 10 rotates about a pivot axis 11 of a rocker shaft (not shown), which is typical for shaft-mounted switchable rocker arms.

Figure 2:
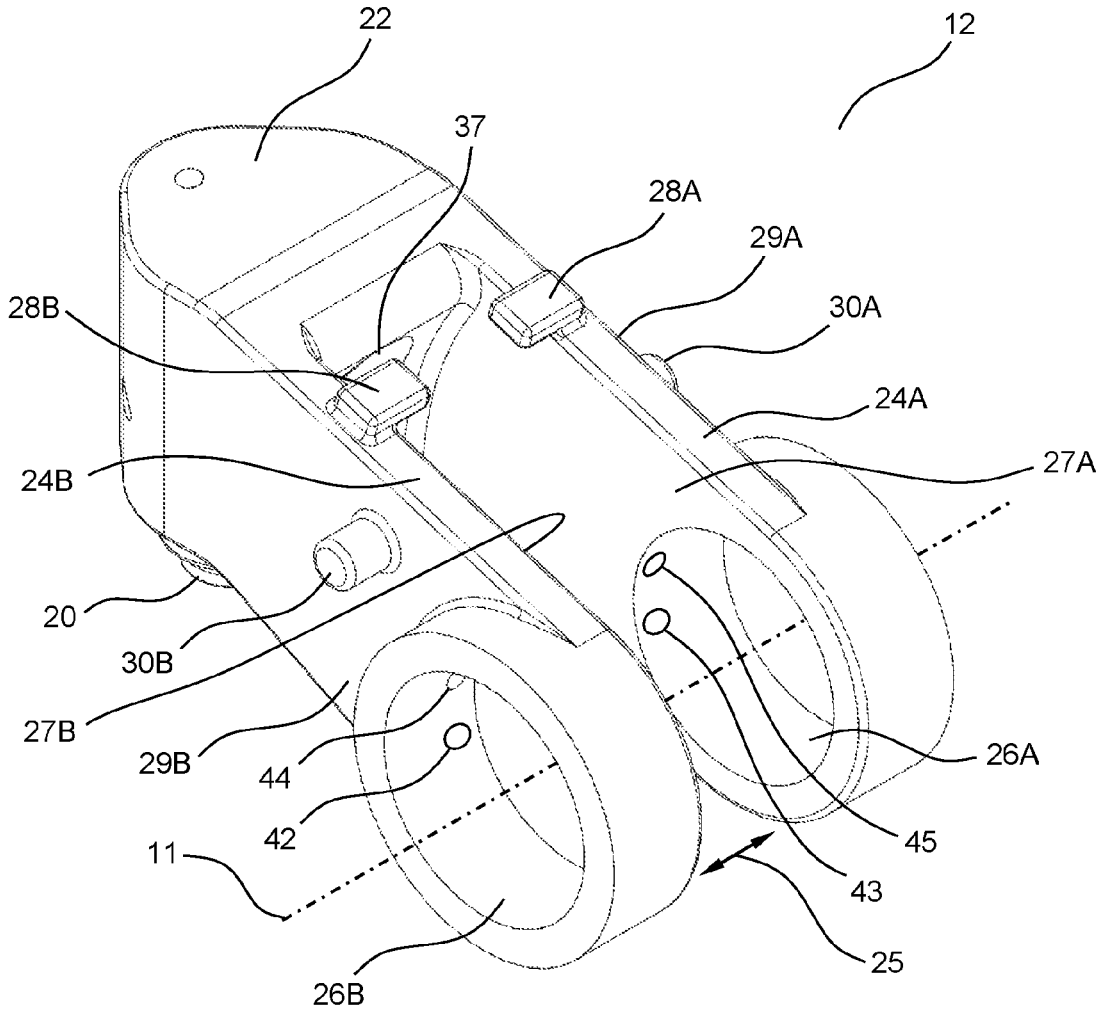
FIG. 2 is perspective view of a valve side lever assembly of the switchable rocker arm of FIG. 1.

Referring to FIG. 2, the valve side lever assembly 12 for the first embodiment of a switchable rocker arm 10 is shown. The valve side lever assembly 12 includes a first housing 22 having a first end with a first arm 24A and a second arm 24B, such that the first arm 24A is axially offset from the second arm 24B, creating a space or passage 25 in between the two arms 24A,24B. The first arm 24A includes a first rocker shaft bore 26A and the second arm 24B includes a second rocker shaft bore 26B. A first stop 28A protrudes inwardly from a first inner wall 27A on the first arm 24A and a second stop 28B protrudes inwardly from a second inner wall 27B on the second arm 24B; the first and second stops 28A,28B limit the rotation of the cam side lever assembly 14 with respect to the valve side lever assembly 12. A first retainer post 30A for the first lost motion spring 16A is present on a first outer wall 29A of the first arm 24A. A second retainer post 30B for the second lost motion spring 16B is present on a second outer wall 29B of the second arm 24B. A second end of the first housing 22 has a valve interface in the form of a hydraulic lash adjuster 20 and a shuttle pin bore 37. A second fluid passage 44 extends from the second rocker shaft bore 26B to the hydraulic lash adjuster 20; a third fluid passage 46, visible in FIGS. 4 and 5, extends from the hydraulic lash adjuster 20 to a second closed end of the shuttle pin bore 37.

Figure 3:
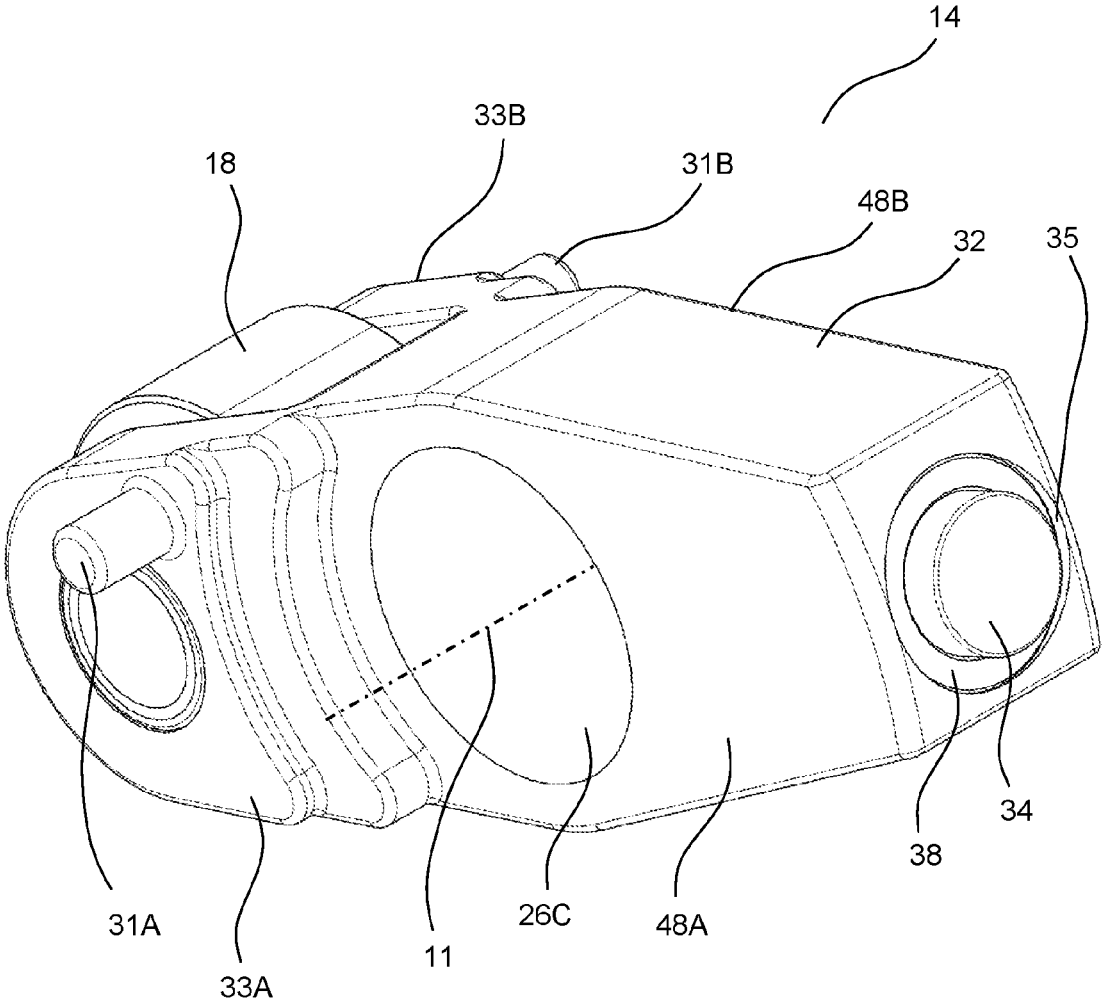
FIG. 3 is a perspective view of a cam side lever assembly of the switchable rocker arm of FIG. 1.

Referring specifically to FIG. 3, the cam side lever assembly 14 for the first embodiment of a switchable rocker arm 10 is shown. The cam side lever assembly 14 includes a second housing 32 having a third end with a cam interface in the form of a roller follower 18, and a fourth end with a locking pin bore 35 that houses an optional sleeve 38 for guiding and interfacing with a locking pin 34. Without the presence of the optional sleeve 38, the locking pin 34 would interface directly with the locking pin bore 35. Other forms of cam interfaces at the third end of the second housing 32 are possible such as a slider pad. A third retainer post 31A for the first lost motion spring 16A is present on a third outer side 33A of the third end of the second housing 32. A fourth retainer post 31B for the second lost motion spring 16B is present on a fourth outer side 33B of the third end of the second housing 32. A third rocker shaft bore 26C is present at a medial position on the second housing 32. The cam side lever assembly 14 fits within the space or passage 25 created by the two arms 24A,24B of the first housing 22 of the valve side lever assembly 12, such that the first arm 24A extends along a first longitudinal side 48A of the second housing 32, and the second arm 24B extends along a second longitudinal side 48B of the second housing 32. In addition, the third rocker shaft bore 26C is in axial alignment with the first and second rocker shaft bores 26A,26B of the first and second arms 24A,24B, respectively, of the first housing 22.

Figure 4:
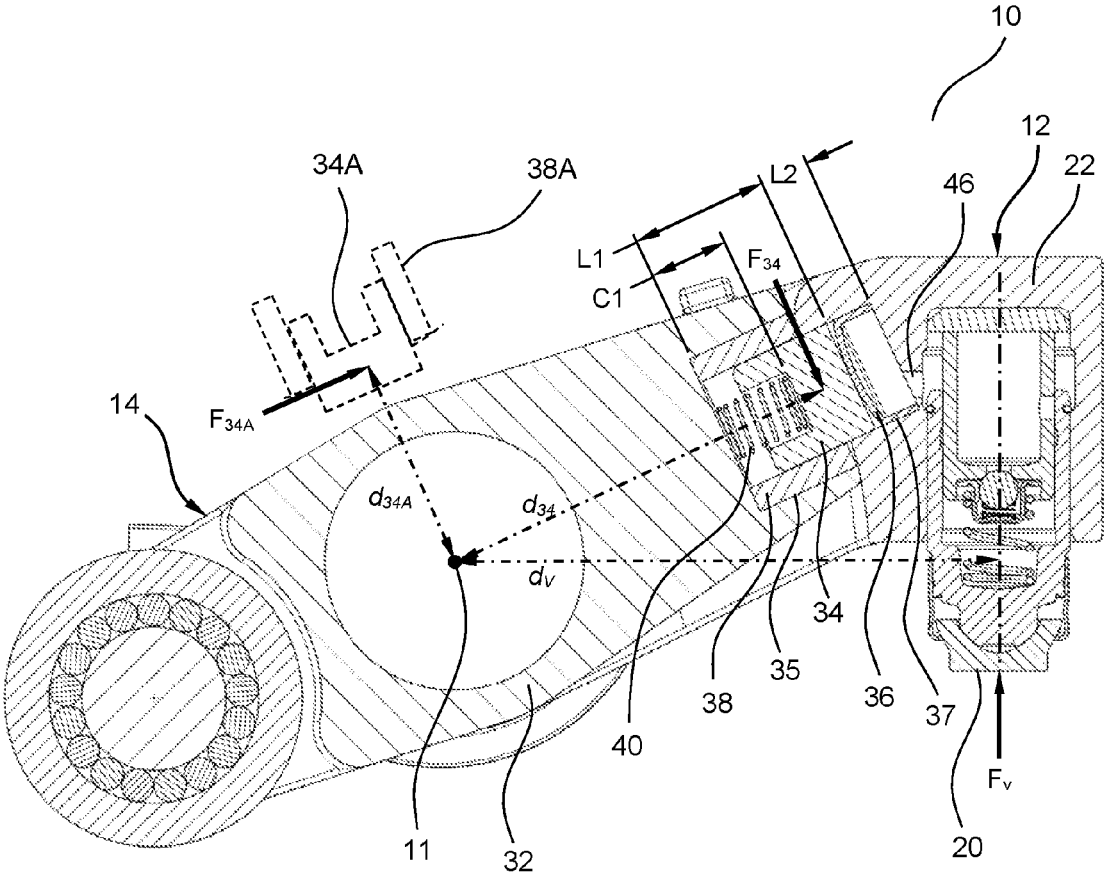
FIG. 4 is a cross-sectional view of the switchable rocker arm of FIG. 1 in a first locked position.

The switchable rocker arm 10 captured in FIGS. 1 through 5 is capable of switching between two discrete valve lift modes, achieved by different longitudinal positions of the locking pin 34. Referring now to FIG. 4, a first locked position is shown at which the locking pin bore 35 of the second housing 32 is axially aligned with the shuttle pin bore 37 of the first housing 22, enabling engagement of the locking pin 34 with both the first housing 22 and the second housing 32. More specifically, the locking pin 34 is engaged with both the shuttle pin bore 37 of the first housing 22 and the optional sleeve 38 arranged within the locking pin bore 35 of the second housing 32. If the optional sleeve 38 is not present, the locking pin 34 would engage directly with the locking pin bore 35. The first locked position facilitates a full valve lift mode such that when the cam side lever assembly 14 is rotationally actuated by the cam, the valve side lever assembly 12 rotates in unison with the cam side lever assembly 14 about the pivot axis 11. In the first locked position, a locking pin bias spring or resilient element 40 with a first compressed length C1, urges the locking pin 34 with a pre-load force to its shown position in FIG. 4. The shown position of the locking pin 34 can be defined or limited by either of two design features: 1). (as shown) the adjacent shuttle pin 36 with a first end engaging the locking pin 34, reaches a second closed or blind end of the shuttle pin bore 37, or 2). any other suitable means of limiting the longitudinal travel of the locking pin 34 within the shuttle pin bore 37. At the first locked position, a third outer end of the locking pin 34 is at a first distance L1 from a fourth closed or blind end of the locking pin bore 35, while the first end of the shuttle pin 36 is at a second distance L2 from a second closed or blind end of the shuttle pin bore 37.

Figure 5:
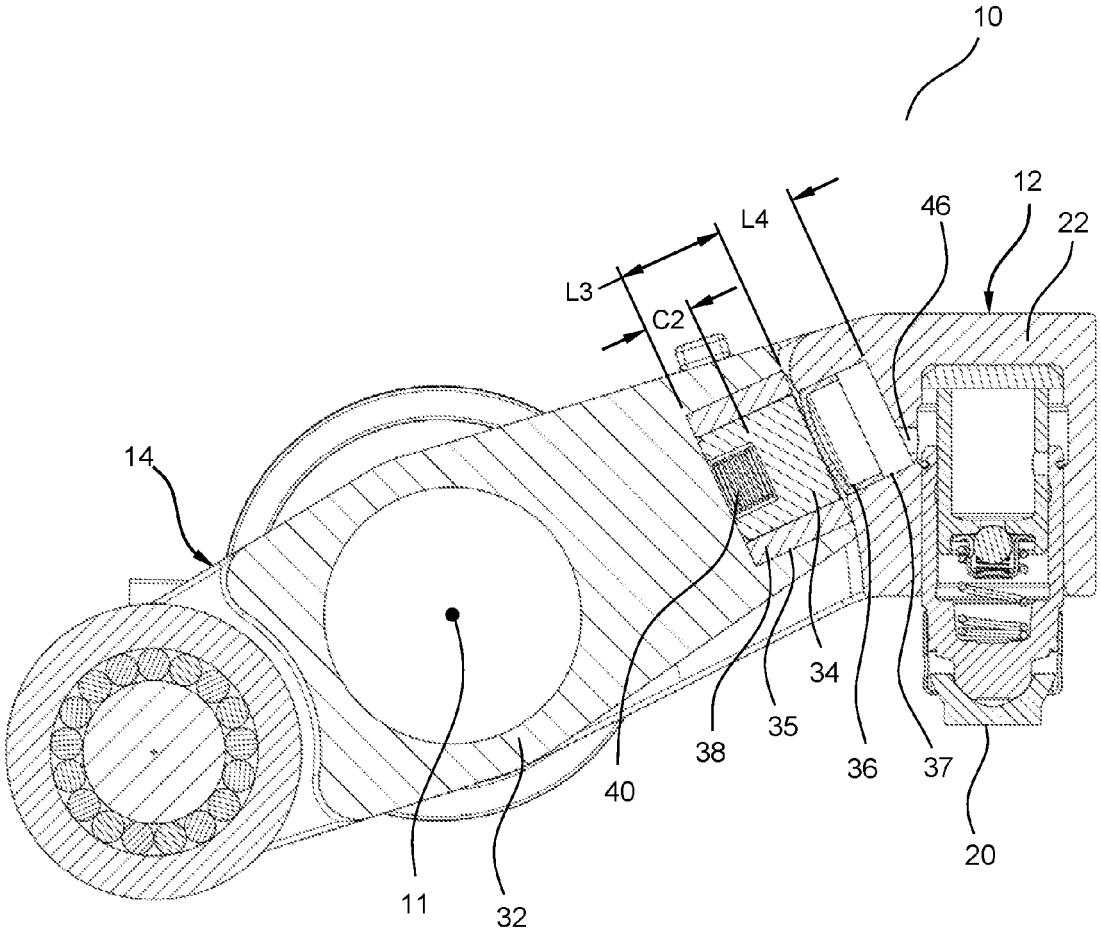
FIG. 5 is a cross-sectional view of the switchable rocker arm of FIG. 1 in a second unlocked position.

Referring now to FIG. 5, a second unlocked position is shown in which the locking pin 34 is completely retracted from the shuttle pin bore 37. This occurs when hydraulic fluid, typically at an engine fluid pump pressure, is delivered to the second closed end of the shuttle pin bore 37 and acts upon the second end of the shuttle pin 36. The force created by the hydraulic pressure acting on the shuttle pin 36 overcomes the pre-load urging force of the compressed bias spring 40 acting on the adjacent and engaged locking pin 34, causing the locking pin 34 to move longitudinally until it disengages the shuttle pin bore 37. Therefore, the third or outer end of the locking pin 34 is closer to the fourth or closed end of the locking pin bore 35, defining a third distance L3, and the first end of the shuttle pin 36 is further away from the second or closed end of the shuttle pin bore 37, defining a fourth distance L4. In the second unlocked position, the bias spring 40 compresses to a second compressed length C2 that is shorter than the first compressed length C1 in the first locked position. The second unlocked position facilitates a no valve lift mode in which the cam side lever assembly 14 is rotationally displaced about the pivot axis 11 by the camshaft independently from the valve side lever assembly 12, which remains stationary. While in the no valve lift or deactivation mode, the first and second lost motion springs 16A,16B provide a force that can: 1). act upon the cam side lever assembly via the third and fourth retainer posts 31A,31B, controlling the motion of the cam side lever assembly 14 such that separation with the camshaft does not occur at a maximum deactivation speed, and 2). act upon the valve side lever assembly 12 via the first and second retainer posts 30A,30B to prevent a pump-up or extended length condition of the hydraulic lash adjuster 20 which could hinder the switching function of the switchable rocker arm 10.

Referring again to FIG. 4, an alternative locking pin 34A and an alternative sleeve 38A are shown with broken lines. Compared to the previously described locking pin 34 and sleeve 38, the location of the alternative locking pin and sleeve 34A,38A are instinctive due to their proximity to the pivot axis 11, requiring low effort to integrate a short and simple hydraulic gallery for actuation of the locking pin 34A. However, analyzing the moment about the pivot axis 11 created by the reactive forces that correspond to each of the two locking pin positions provides further insight into the ideal location for a locking pin. A force $F_V$ applied to the hydraulic lash adjuster 20 (or other suitable valve interface) of the switchable rocker arm 10 by an engine valve (not shown) creates a moment about the pivot axis 11 equal to the magnitude of the force $F_V$ multiplied by a magnitude of a vector $d_V$, as shown in FIG. 4 and by the equation below:

$$M_{11}=F_v \times d_v$$

where: $d_V$=perpendicular distance from the pivot axis 11 to a line of action of the force $F_V$.

To counteract this moment created on the switchable rocker arm 10 by the engine valve, a counter-moment is present about the central axis 11 created by a reactive force $F_{34}$ of the locking pin 34, hereafter termed "reactive shear force", multiplied by a magnitude of vector $d_{34}$. Assuming that a sum of moments about the pivot axis 11 is zero, the reactive shear force $F_{34}$ can be expressed as shown below:

$$\circlearrowright + \sum M_{11} = 0$$

$$(F_{34} \times d_{34}) - (F_v \times d_v) = 0$$

$$F_{34} = \frac{(F_v d_v)}{d_{34}}$$

where: $d_{34}$=perpendicular distance from the pivot axis 11 to a line of action of the reactive shear force $F_{34}$.

One can observe that the magnitude of the reactive shear force $F_{34}$ of the locking pin 34 is inversely proportional to the magnitude of vector $d_{34}$. Therefore, as the magnitude of vector $d_{34}$ increases, the reactive shear force $F_{34}$ applied to the locking pin 34 decreases. Furthermore, with reference to FIG. 4 and the distance vectors $d_{34}$ and $d_{34A}$ for the respective locations of the locking pin 34 located at the fourth end of the second housing 32 and the alternative locking pin 34A, the following equation provides an amount of reactive shear force reduction due to a more distant locking pin:

$$\text{reactive shear force reduction (\%)} = \frac{(d_{34} - d_{34A})}{d_{34}} \times 100$$

where:

$d_{34}$=perpendicular distance from the pivot axis 11 to a line of action of the reactive shear force $F_{34}$.

$d_{34A}$=perpendicular distance from the pivot axis 11 to a line of action of the reactive shear force $F_{34A}$.

Quantifying the difference in reactive shear force between the two locking pin locations, a distance of 14 millimeters is assumed for $d_{34A}$ that corresponds with the alternative locking pin 34A shown in broken lines, and a distance of 28 millimeters is assumed for $d_{34}$ that corresponds with the locking pin 34 shown in solid lines. Using the equation for reactive shear force reduction, a reduction of 50% is achieved by locating the locking pin 34 at the fourth end of the second housing 32 versus the less distant location of the alternative locking pin 34A, providing significantly reduced locking pin stress and resulting wear.

Figure 9:
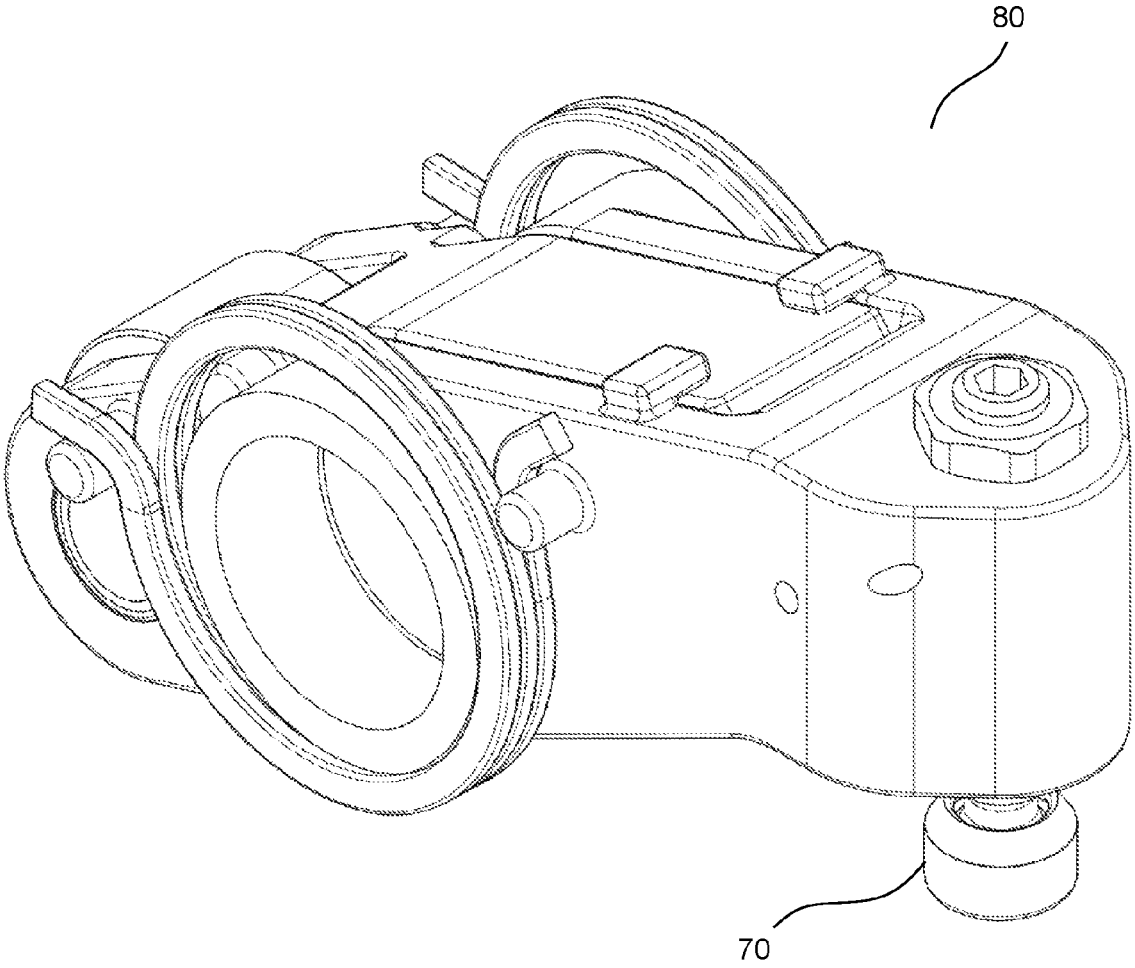
FIG. 9 is a perspective view of the second embodiment of a switchable rocker arm.

Referring to FIG. 9, a second embodiment of a switchable rocker arm 80 is shown that utilizes an adjusting screw assembly 70 as a valve interface which potentially reduces the complexity and cost of the switchable rocker arm 80.

Figure 6:
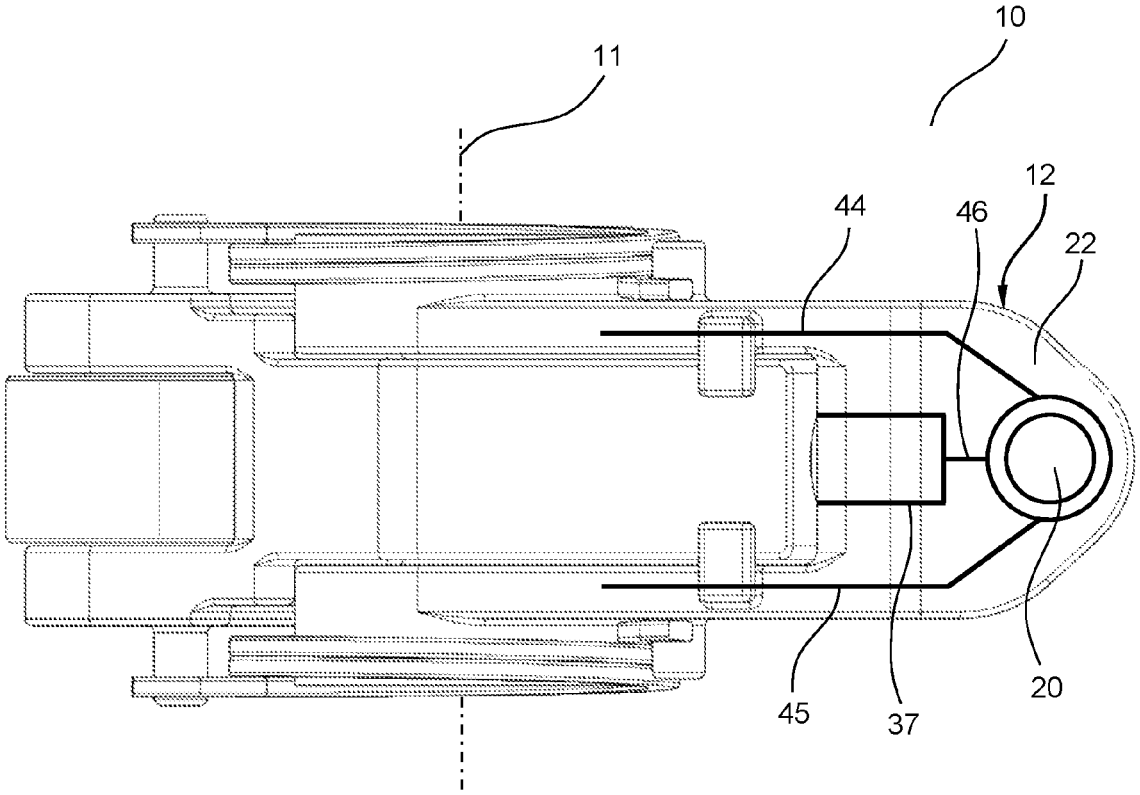
FIG. 6 is a top view of a schematic of a fluid passage network for the switchable rocker arm of FIG. 1.
Figure 7:
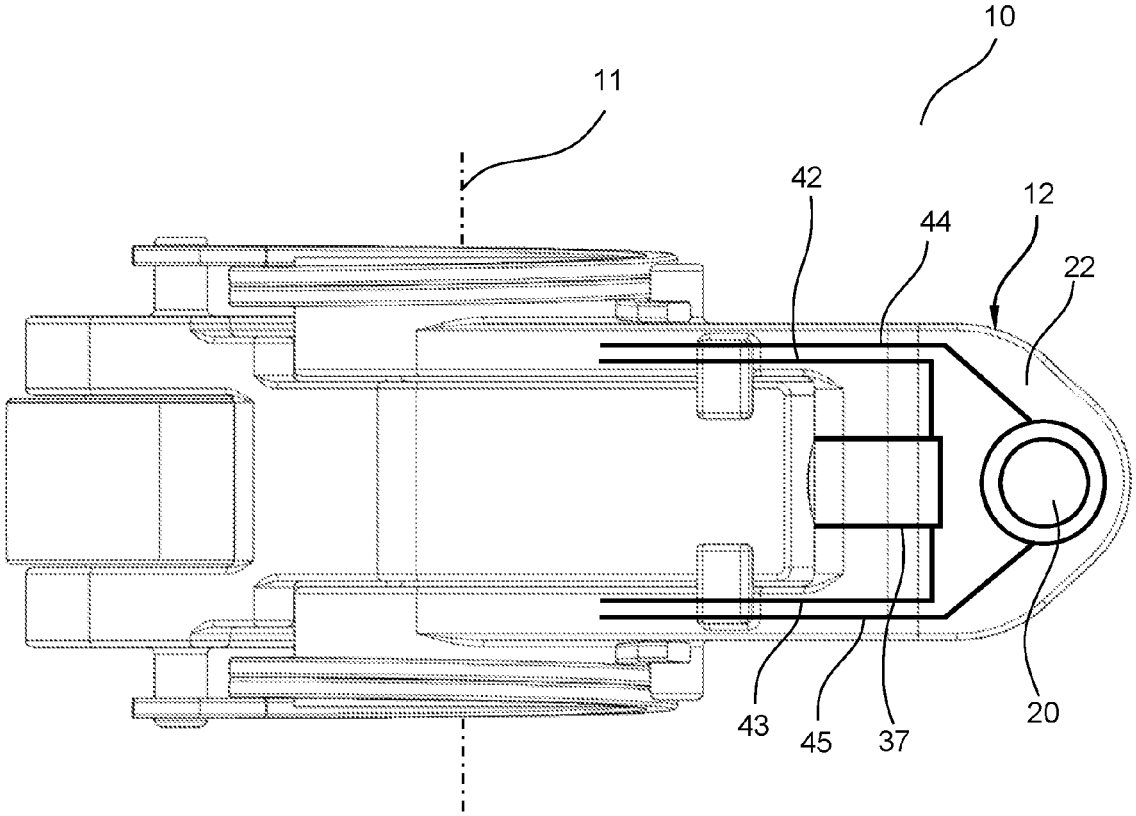
FIG. 7 is a top view of a variation of a schematic of a fluid passage network for the switchable rocker arm of FIG. 1.
Figure 8:
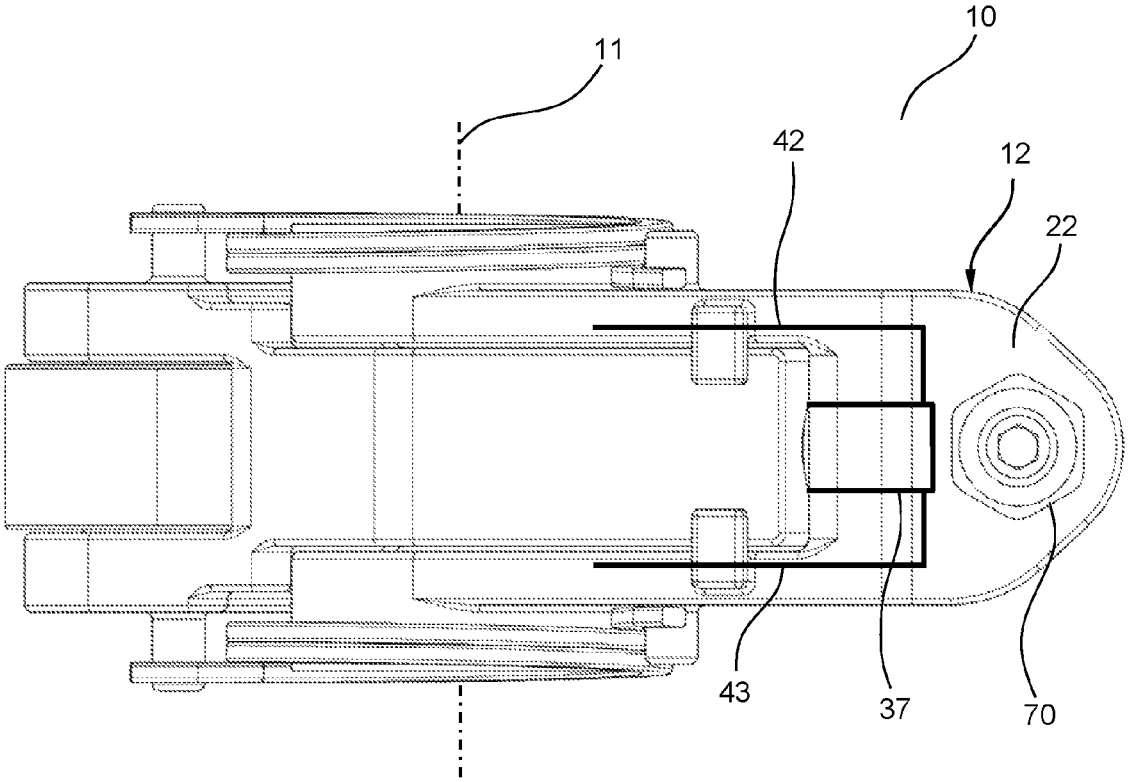
FIG. 8 is a top view of a schematic of a fluid passage network for a second embodiment of a switchable rocker arm.

FIGS. 6 through 8 show various oil gallery or fluid passage networks in schematic form to accommodate the first and second embodiments of switchable rocker arms 10,80. FIG. 6 shows a schematic of a fluid passage network for the first embodiment of a switchable rocker arm 10 that utilizes a hydraulic lash adjuster 20 at the second end of the first housing 22 of the valve side lever assembly 12. Referencing FIG. 6 together with the perspective view of the valve lever side assembly 12 of FIG. 2, a second fluid passage 44 is shown that extends from the second rocker shaft bore 26B to the hydraulic lash adjuster 20. Optionally, an additional second fluid passage 45 can be utilized that extends from the first rocker shaft bore 26A to the hydraulic lash adjuster 20. A third fluid passage 46 extends from the hydraulic lash adjuster 20 to the second closed end of the shuttle pin bore 37. Thus, for the fluid passage network shown in FIG. 6, hydraulic fluid is provided first to the hydraulic lash adjuster 20, and then second to the second end of the shuttle pin 37, in series.

FIG. 7 shows a variation of a fluid passage network for the first embodiment of a switchable rocker arm 10 that utilizes a hydraulic lash adjuster 20 at the second end of the first housing 22 of the valve side lever assembly 12. Referring to FIG. 7 together with the perspective view of the valve lever side assembly 12 in FIG. 2, separate fluid passages exist for the hydraulic lash adjuster 20 and the shuttle pin bore 37. The second fluid passage 44 and optional additional second fluid passage 45 from FIG. 6 remain in FIG. 7's network; however, in this variation, the shuttle pin bore 37 receives hydraulic fluid via a first fluid passage 42 that extends from the second rocker shaft bore 26B to the second end of the shuttle pin bore 37. Optionally, an additional first fluid passage 43 can be utilized that extends from the first rocker shaft bore 26A to the second closed end of the shuttle pin bore 37.

FIG. 8 shows a fluid passage network for the second embodiment of a switchable rocker arm 80 that utilizes an adjusting screw assembly 70 as a valve interface. Since the adjusting screw assembly 70 does not typically require a hydraulic fluid feed, FIG. 8's fluid passage network is the simplest of the three fluid passage networks shown, requiring only the first fluid passage 42 and the optional additional first fluid passage 43 that extend from the second and first rocker shaft bores 26B,26A to the second end of the shuttle pin bore 37. In the event that the design of the adjusting screw assembly 70 incorporates a means of lubricating the interface with the valve and, thus, requires an oil feed, the fluid passage networks of either FIG. 6 or FIG. 7 could be applied.

Having thus described various embodiments of the present switchable rocker arm in detail, it is to be appreciated and will be apparent to those skilled in the art that many physical changes, only a few of which are exemplified in the detailed description above, could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

What is claimed is:

1. A switchable rocker arm comprising:

a valve side lever assembly including a first housing having a first end with a first rocker shaft bore and a second rocker shaft bore, and a second end with a shuttle pin bore;

a cam side lever assembly including a second housing having a third end with a camshaft interface, a fourth end with a locking pin bore, and a third rocker shaft bore at a medial position; wherein, the third rocker shaft bore is axially aligned with the first and second rocker shaft bores; and, a coupling assembly, including a locking pin arranged at least partially within the locking pin bore, and a shuttle pin arranged at least partially within the shuttle pin bore with a first end of the shuttle pin engaging the locking pin.

2. The switchable rocker arm of claim 1, including:

a first locked position with the locking pin bore axially aligned with the shuttle pin bore, the locking pin arranged partially within the shuttle pin bore and partially within the locking pin bore with a third end of the locking pin at a first distance from a fourth closed end of the locking pin bore of the first housing, and the first end of the shuttle pin at a second distance from a second closed end of the shuttle pin bore of the second housing; and, a second unlocked position with the third end of the locking pin at a third distance from the fourth closed end of the locking pin bore of the first housing, and the first end of the shuttle pin at a fourth distance from the second closed end of the shuttle pin bore of the second housing, wherein the third distance is less than the first distance and the fourth distance is greater than the second distance.

3. The switchable rocker arm of claim 2, further comprising a resilient element in contact with the locking pin, the resilient element having a first compressed length in the first locked position and a second compressed length in the second unlocked position, wherein the first compressed length is greater than the second compressed length.

4. The switchable rocker arm of claim 3, further comprising a sleeve arranged within the locking pin bore at the fourth end of the second housing.

5. The switchable rocker arm of claim 3, further comprising a lost motion resilient element arranged between the first housing and the second housing.

6. The switchable rocker arm of claim 3, further comprising a cam roller follower arranged on the third end of the second housing.

7. The switchable rocker arm of claim 3, further comprising at least one second housing rotational stop configured on the first housing.

8. The switchable rocker arm of claim 3, further comprising at least one first fluid passage within the first housing from the first or second rocker shaft bore to the second closed end of the shuttle pin bore.

9. The switchable rocker arm of claim 3, further comprising an adjusting screw assembly arranged at the second end of the first housing.

10. The switchable rocker arm of claim 3, further comprising a hydraulic lash adjuster arranged at the second end of the first housing.

11. The switchable rocker arm of claim 10, further comprising at least one second fluid passage within the first housing from the first or second rocker shaft bore to the hydraulic lash adjuster, and at least one third fluid passage from the hydraulic lash adjuster to the second closed end of the shuttle pin bore.

12. The switchable rocker arm of claim 10, further comprising at least one first fluid passage within the first housing from the first or second rocker shaft bore to the hydraulic lash adjuster and at least one second fluid passage from the first or second rocker shaft bore to the second closed end of the shuttle pin bore.

13. The switchable rocker arm of claim 2, wherein the third distance defines a position where the locking pin is disengaged from the shuttle pin bore.

14. The switchable rocker arm of claim 2, wherein the first locked position defines a first valve lift mode and the second unlocked position defines a second valve lift mode.

15. The switchable rocker arm of claim 14, wherein the first valve lift mode is a full valve lift mode and the second valve lift mode is a no valve lift mode.

16. The switchable rocker arm of claim 1, further comprising a first arm having the first rocker shaft bore, a second arm having the second rocker shaft bore, the two arms defining a space therebetween, and extending along opposed longitudinal sides of the cam side lever assembly.

* * * * *